US011873018B2

(12) United States Patent
Mandler

(10) Patent No.: US 11,873,018 B2
(45) Date of Patent: Jan. 16, 2024

(54) NON-STOP TRANSPORTATION SYSTEM

(71) Applicant: DIRECTRAINS LTD., Zihron Ya'akov (IL)

(72) Inventor: Alberto Rodrigo Mandler, Zihron Ya'akov (IL)

(73) Assignee: DIRECTRAINS LTD., Zihron Ya'akov (IL)

( * ) Notice: Subject to any disclaimer, the term of this patent is extended or adjusted under 35 U.S.C. 154(b) by 171 days.

(21) Appl. No.: 17/601,726

(22) PCT Filed: Mar. 8, 2020

(86) PCT No.: PCT/IB2020/051995

§ 371 (c)(1),
(2) Date: Oct. 6, 2021

(87) PCT Pub. No.: WO2020/208438

PCT Pub. Date: Oct. 15, 2020

(65) Prior Publication Data

US 2022/0204062 A1 Jun. 30, 2022

Related U.S. Application Data

(60) Provisional application No. 62/830,566, filed on Apr. 8, 2019.

(51) Int. Cl.

| | |
|---|---|
| ***B61L 27/10*** | (2022.01) |
| ***B61L 27/20*** | (2022.01) |
| ***B61K 1/00*** | (2006.01) |

(52) U.S. Cl.

CPC ..... *B61L 27/10* (2022.01); *B61K 1/00* (2013.01); *B61L 27/20* (2022.01)

(58) Field of Classification Search

CPC ..... B61L 27/10; B61L 27/20; B61K 1/00

See application file for complete search history.

(56) References Cited

U.S. PATENT DOCUMENTS

| | | | |
|---|---|---|---|
| 335,611 | A | 2/1886 | Moorman |
| 593,195 | A | 11/1897 | Cavniss |

(Continued)

FOREIGN PATENT DOCUMENTS

| | | | |
|---|---|---|---|
| CN | 101480954 | A | 7/2009 |
| CN | 103465915 | A | 12/2013 |

(Continued)

OTHER PUBLICATIONS

Hunter-Zaworski, "Analysis of Passenger Incident Data from Five Rail Transit Systems," MDPI Journal Safety, vol. 3, No. 21, pp. 1-10, year 2017.

(Continued)

*Primary Examiner* — Gertrude Arthur Jeanglaude

(74) *Attorney, Agent, or Firm* — Kligler & Associates Patent Attorneys Ltd.

(57) ABSTRACT

A system (10, 99) includes a vehicle (11, 111) and a car (1, 2, 3, 4, 12, 14, 16, 18, 26, 27, 28). The vehicle (11, 111) is configured to move, along a route (33) including at least a station (22, 24, 29, 30), without stopping at the station (22, 24, 29, 30). The car (1, 2, 3, 4, 12, 14, 16, 18, 26, 27, 28) is configured to (i) load an object from the station (22, 24, 29, 30) and move for integrating with the vehicle (11, 111), or (ii) detach from the vehicle (11, 111) and stop at the station (22, 24, 29, 30) for unloading the object.

20 Claims, 3 Drawing Sheets

(56) References Cited

U.S. PATENT DOCUMENTS

| | | | | |
|---|---|---|---|---|
| 950,263 | A | 2/1910 | Harpster | |
| 1,450,248 | A | 4/1923 | Carr | |
| 3,354,836 | A | 11/1967 | Willison et al. | |
| 3,848,533 | A | 11/1974 | Grow | |
| 5,312,007 | A | 5/1994 | Kaufhold et al. | |
| 5,797,330 | A * | 8/1998 | Li | B61B 13/06 701/19 |
| 8,370,006 | B2 * | 2/2013 | Kumar | B61C 17/12 701/19 |
| 10,328,960 | B2 * | 6/2019 | Fifield | B61L 27/16 |
| 2003/0167960 | A1 * | 9/2003 | Rosenblatt | B61K 1/00 104/27 |
| 2005/0039629 | A1 | 2/2005 | Mayer et al. | |
| 2007/0272115 | A1 | 11/2007 | Mayer et al. | |
| 2008/0103639 | A1 | 5/2008 | Troy et al. | |
| 2009/0152391 | A1 | 6/2009 | McWhirk | |
| 2013/0153714 | A1 | 6/2013 | Qu et al. | |
| 2015/0224845 | A1 | 8/2015 | Anderson et al. | |
| 2016/0274591 | A1 | 9/2016 | Bick et al. | |

FOREIGN PATENT DOCUMENTS

| | | | |
|---|---|---|---|
| CN | 106828507 | A | 6/2017 |
| DE | 2745158 | A1 | 4/1979 |
| DE | 102007038345 | A1 | 9/2008 |
| GB | 2232649 | A | 12/1990 |
| TW | 200840746 | A | 10/2008 |
| WO | 2016108785 | A1 | 7/2016 |
| WO | 2018071991 | A1 | 4/2018 |
| WO | 2021014230 | A1 | 1/2021 |

OTHER PUBLICATIONS

Dingler et al., "Determining the Causes of Train Delay," Proceedings of the American Railway Engineering and Maintenance of-Way Association (AREMA) Annual Conference 2010, pp. 1-14, year 2010.

Priestmangoode, "Britain's Leading Transport Designer Unveils the Future for 21st Century Train Travel," pp. 1-2, Dec. 2014.

YouTube Clip, "The Train that Never Stops at a Station," Apr. 14, 2010, https://www.youtube.com/watch?V=p9lg19gYP9o.

YouTube Clip, Moving Platform: Train Stations go Mobile with High-Speed docking DVICE2.mp4, Jun. 25, 2011, https://www.youtube.com/watch?v=19hXm0J_3Uc.

YouTube Clip, "Automatic Train Coupler," Rail System Net, Apr. 23, 2015, https://www.youtube.com/watch?V=kpf2f5dPIFg.

Pfaff, "Analysis of Big Data Streams to Obtain Braking Reliability Information for Train Protection Systems," Open Access Article, Conference Contribution, Asia Pacific Conference of the Prognostics and Health Management Society 2017, pp. 1-7, year 2017.

Funke et al., "Development of Functional Requirements for Sustainable and Attractive European Rail Freight—D5.1—State of the Art on Automatic Couplers," Project Funded from the European Union's Horizon 2020 Research and Innovation Programme, pp. 1-72, Mar. 3, 2017.

Voith, "Railways Couplers and Connections", Product Information, pp. 1-16, year 2021 as downloaded from https://voith.com/corp-en/connection-components-couplings/railway-couplers.html?99624%5B%5D=4.

Railway Engineering Standard I.S. EN 12663-1:2010, "Railway Applications—Structural Requirements of Railway Vehicle Bodies—Part 1: Locomotives and Passenger Rolling Stock (and Alternative Methods for Freight Wagons)," p. 1-39, Mar. 2010.

Railway Engineering Standard SS EN 16019:2014, "Railway Applications—Automatic Coupler—Performance Requirements, Specific Interface Geometry and Test Method," Swedish Standards Institute, pp. 1-40, Mar. 31, 2014.

International Application # PCT/IB2020051995 Search Report dated Jun. 18, 2020.

International Application # PCT/IB2020055568 Search Report dated Sep. 9, 2020.

EP Application # 20787120.3 Search Report dated Dec. 6, 2022.

EP Application # 20843887.9 Search Report dated Jun. 30, 2023.

* cited by examiner

NON-STOP TRANSPORTATION SYSTEM

CROSS-REFERENCE TO RELATED APPLICATIONS

This application is U.S. National Phase of PCT Application PCT/IB2020/051995, which claims the benefit of U.S. Provisional Patent Application 62/830,566 filed Apr. 8, 2019. The disclosures of these related applications are incorporated herein by reference.

FIELD OF THE INVENTION

The present invention relates generally to transportation systems, and particularly to non-stop transportation systems.

BACKGROUND OF THE INVENTION

Various types of non-stop transportation systems, such as non-stop trains, have been described in the patent literature.

For example, U.S. Pat. No. 3,848,533 describes a non-stop rapid mass transit system comprised of individually operable cars adapted to take on and to let off passengers at a multiplicity of enroute stations. The system is characterized by trains capable of operating on a single track and simultaneously progressing in opposite directions of travel, the cars being continuously utilized as and when they reach enroute stations from which they are operable on lateral feeder tracks and the like. The composition of each train involves at least three cars and one of which remains in motion at operating speed, a first pair of said cars travel together and are uncoupled on approach to an enroute station, and a second pair of cars travel together and are coupled on departure from said enroute station.

PCT Patent Publication WO 2016/108785 describes a high-speed train system comprising at least one ring-shaped route, at least one sub-route branching off from and then joining back said route, stations provided at said sub-routes, at least one train proceeding continuously on said route in a nonstop manner, and at least one changing wagon which can be attached to or detached from the rear of the train when required.

SUMMARY OF THE INVENTION

An embodiment of the present invention that is described herein provides a system including a vehicle and a car. The vehicle is configured to move, along a route including at least a station, without stopping at the station. The car is configured to (i) load an object from the station and move for integrating with the vehicle or (ii) detach from the vehicle and stop at the station for unloading the object.

In some embodiments, the car and the vehicle are configured to integrate with one another, and to detach from one another, while both the vehicle and the car are moving. In other embodiments, the vehicle includes one or more cars, and at least one of the car and the vehicle includes a transportation equipment selected from a list consisting of a bus, an intercity train, a light train, a suburban rail, an underground train, a boat, an automobile, a truck, a ship, an aircraft and a drone. In yet other embodiments, the object includes one or more object types selected from a list consisting of: (a) a passenger, (b) a parcel, and (c) cargo.

In an embodiment, the car is an origin car and the station is an origin station of the object, and the system further includes a destination car, which is integrated with the vehicle and is configured to detach from the vehicle and to unload the object at a destination station, such that, when the origin car and the vehicle are moving between the origin station and the destination station, the object moves from the origin car to the destination car. In another embodiment, at least one of the car and the vehicle includes a motor. In yet another embodiment, the vehicle includes at least first and second cars configured to integrate with the vehicle and to detach from the vehicle, and the motor is configured to move from the first car to the second car.

In some embodiment, the system includes a control sub-system having (i) one or more sensors, (ii) one or more communication devices, and (iii) at least a processor, which is configured to receive signals from the sensors and the communication devices, and to control at least a parameter of at least one of the vehicle, the car and the station. In other embodiments, the system includes a traditional vehicle, which is configured to stop at predefined stations, and the control sub-system is configured to operate the vehicle and the car in conjunction with the traditional vehicle. In yet other embodiments, the parameter includes one or more parameters selected from a list consisting of: (a) speed, (b) acceleration and deceleration, (c) distance between the car and the vehicle, (d) distance to or from a closest station, (e) status of the car, (f) status of the vehicle, and (g) braking capabilities.

In an embodiment, the status of the car includes at least one of: detached from the vehicle, integrated with the vehicle, loading or unloading the objects at the station, moving to or from the station, and not operational. In another embodiment, the control sub-system is configured to specify, based on the signals received from at least one of the sensors and the communication devices, a configuration of at least one of the vehicle and the car. In yet another embodiment, the route includes multiple stations and the vehicle has multiple cars integrated therewith, and the control sub-system is configured to specify a number of cars in the vehicle based on a distance between at least two adjacent stations of the route.

In some embodiments, the control sub-system is configured to specify at least one of: (i) a first number of multiple cars for loading a first plurality of the first object and integrating with the vehicle, and (ii) a second number of multiple cars for detaching from the vehicle and stopping at the station for unloading a second plurality of the second object. In other embodiments, the control sub-system is configured to adjust at least one of the first and second numbers, based on a signal indicative of a change in at least one of the first and second pluralities. In yet other embodiments, the system includes a first set of one or more first cars and a second set of one or more second cars, and the control sub-system is configured to control a merge of the first and second sets into a merged vehicle. In yet other embodiments, the vehicle includes a first set of one or more first cars positioned at a front of the car and a second set of one or more second cars positioned at a rear of the car, and the control sub-system is configured to control a split of the vehicle into a first sub-vehicle including the first set and a second sub-vehicle including the second set.

In an embodiment, the system includes a first communication device at the first set and a second communication device at the second set, the first and second communication devices are configured to exchange communication signals with one another, and, in case of a communication-loss during the split, the first set is configured to move at a first speed and the second set is configured to move at a second speed, lower than the first speed. In another embodiment, the control sub-system is configured to control the first and second speed for obtaining at least a safety distance between the first set and the second set.

There is additionally provided, in accordance with an embodiment of the present invention, a method including moving a vehicle along a route that includes at least a station, without stopping at the station. An object is moved from the station to a car and the car is moved for integrating with the vehicle, or the car is detached from the vehicle and stopped at the station for unloading the object.

The present invention will be more fully understood from the following detailed description of the embodiments thereof, taken together with the drawings in which:

DETAILED DESCRIPTION OF EMBODIMENTS

Overview

Figure 2:
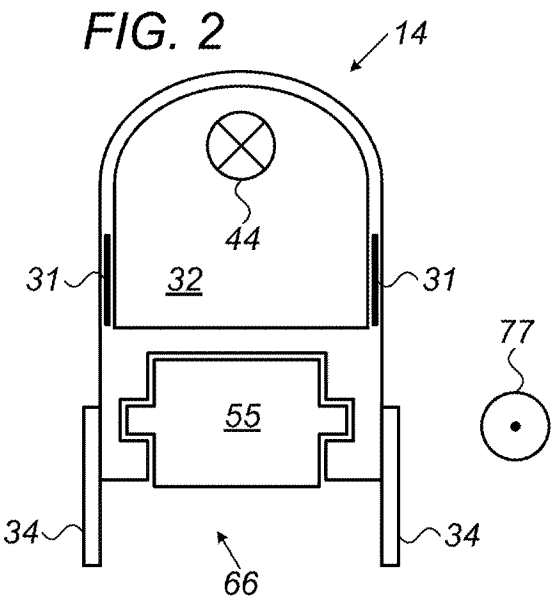
FIG. 2 is a schematic, rear view of a car used in a transportation system, in accordance with an embodiment of the present invention.

The rapid increase in population and mobility creates a growing burden on transportation systems and requires a large investment in infrastructure to meet the growing transportation needs.

Embodiments of the present invention that are described hereinbelow provide methods and systems for improving the efficiency of existing transportation infrastructures by integrating a new transportation system that can transport objects, inter alia, on the existing infrastructures and increase their efficiency.

In some embodiments, the system comprises a vehicle, such as a train for transporting passengers, which is configured to move, along a transportation route comprising multiple stations, without stopping at any of the stations.

The system further comprises one or more cars. A car may serve as an "origin car" that is configured to load a passenger from an origin station and to move along the route for coupling with the train. Additionally or alternatively, a car may serve as a "destination car" that is configured to decouple from the train before arriving at a destination station of the passenger, and to reach a full stop at the destination station for unloading the passenger.

In some embodiments, the coupling and decoupling are carried out when both the train and the cars are moving, and therefore referred to herein as dynamic coupling and dynamic decoupling.

In some embodiments, the origin car from the origin station is typically coupled at the front side of the train. After the car is coupled to the train, the passenger moves toward the rear of the train and accesses the destination car before decoupling from the train when the train is approaching the destination station.

In some embodiments, the system comprises a control sub-system and displays for administrating the schedule of the cars and trains, the coupling and decoupling processes, and the information displayed to the passengers and operators of the system. The control sub-system is further configured to adjust the train configuration (e.g., number of cars), movement speed, and other parameters in response to the transportation needs. Moreover, the control sub-system is configured to operate the disclosed trains and cars in conjunction with traditional trains that stop at predefined stations.

In some embodiments, a passenger does not have to wait for a specific car and can board the next car at the platform. During the ride, the control sub-system will guide the passenger to his or her destination car—The car that will eventually detach from the train and stop at the passenger's destination station. Moreover, once departed from the origin station, the train and cars continue moving the passenger directly to the destination station without stopping. As a result, transportation is faster and passengers spend less time commuting.

In some embodiments, the train has multiple electric and/or diesel motor units. For example, an electric multiple unit (EMU) and/or a diesel multiple unit (DMU). The EMU and DMU are multiple-units trains consisting of self-propelled cars using, respectively, electricity or diesel as the motive power.

In alternative embodiments, the train may comprise multiple locomotive motors (e.g., electrical motors), configured to be moved between cars of the train in accordance with the operational needs of the transportation system.

The disclosed techniques are not limited to trains. In some embodiments, the transportation system may comprise any other type of transportation vehicle, such as but not limited to a bus, an intercity train, a light train, a suburban rail, an underground train, a boat, an automobile, a truck and an aircraft. Moreover, the transportation system may transport any suitable types of objects, e.g., passengers, parcels, cargo or any suitable combination thereof.

The disclosed techniques improve the efficiency of existing transport infrastructure, enable an increase ofthe passenger volume, and reduces the commuting time for each passenger.

System Description

Figure 1:
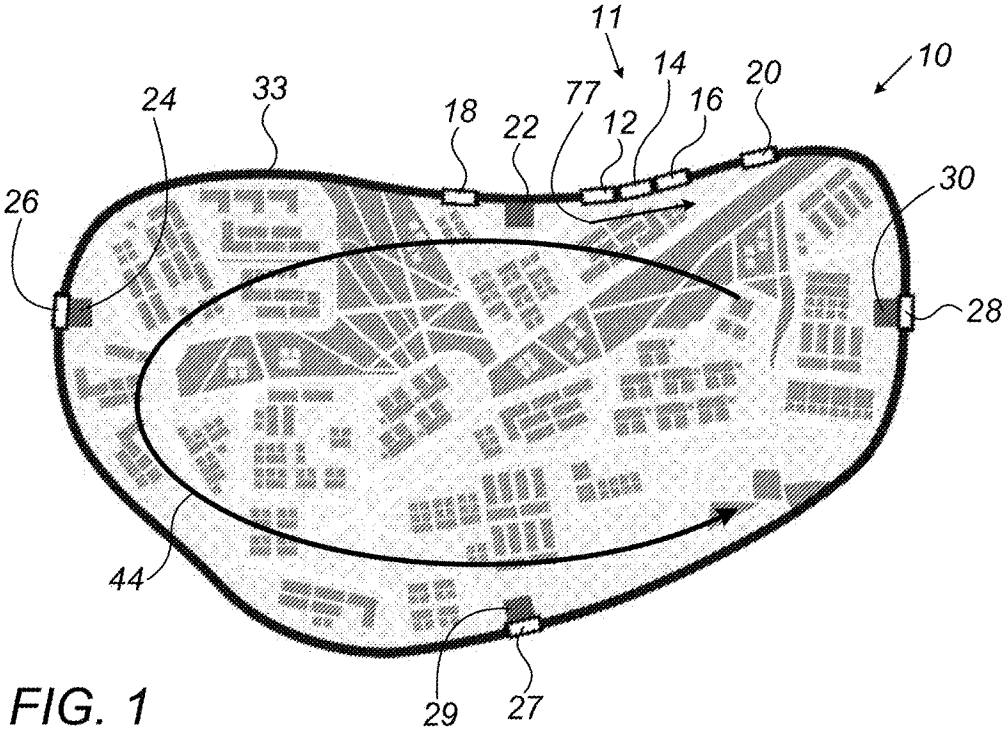
FIG. 1 is a schematic, pictorial illustration of a system for transporting objects without stopping, in accordance with an embodiment of the present invention.

FIG. 1 is a schematic, pictorial illustration of a system 10 for transporting objects without stopping, in accordance with an embodiment of the present invention. In some embodiments, system 10 comprises a vehicle 11 having one or more cars. In the present example, vehicle 11 comprises a train having cars 12, 14 and 16 coupled to one another and arranged in a column along a track, referred to herein as a route 33.

In some embodiments, vehicle 11 is configured to move, in direction 44 along route 33 having one or more stations (e.g., stations 22, 24, 29 and 30), without stopping at any of the aforementioned stations. Moreover, vehicle 11 continuously moves along route 33, typically at a predefined speed, without changing its velocity when passing by a station or when moving between stations. The speed of vehicle 11 may be constant along route 33, or may change to a desired speed in accordance with the administrative requirements of system 10.

In the example of FIG. 1, route 33 appears to be circular. In other embodiments, route 33 may have any other suitable shape and/or configuration, such as but not limited to a linear shape (e.g., north to south), a curved shape, and/or two routes crossing one another.

In some embodiments, system 10 comprises one or more cars, such as cars 18, 26, 27 and 28, each of which is configured to load an object (e.g., a passenger) from a station and to move for integrating with vehicle 11.

In the example shown in FIG. 1, car 18 loads passengers from station 22 and, when vehicle 11 is located at a predefined distance from station 22, car 18 starts moving along route 33 in direction 44. In such embodiments, car 18 accelerates after departing from station 22 and system 10 is configured to match the speed of vehicle 11 and car 18 when making a physical contact therebetween.

In other words, car 18 departs from station 22 before vehicle 11 passes by station 22, e.g., when vehicle 11 is located at the aforementioned predefined distance from station 22. Subsequently, car 18 accelerates, for a predefined time interval, so as to obtain approximately the speed of vehicle 11. During the predefined time interval, vehicle 11 that moves at a speed higher than that of car 18, reduces the distance therebetween. At the end of the predefined time interval, vehicle 11 makes physical contact with car 18 when the speeds of car 18 and vehicle 11 are approximately matched. Subsequently, vehicle 11 and car 18 are making a dynamic coupling therebetween so that car 18 is integrated into vehicle 11 and constitutes the front car thereof.

In the context of the present disclosure and in the claims, the terms "about" or "approximately" for any numerical values or ranges indicate a suitable dimensional tolerance that allows the part or collection of components, or a physical parameters such as speed and time, to function for its intended purpose as described herein. More specifically, "about" or "approximately" may refer to the range of values ±20% of the recited value, e.g. "about 90%" may refer to the range of values from 71% to 99%.

In some embodiments, at least one of (and typically all of) the cars of system 10 is configured to detach from vehicle 11 (when vehicle 11 moves) and to decelerate for a given time interval from a respective station, so as to obtain a full stop at the respective station for unloading another object (e.g., another passenger).

In the example shown in FIG. 1, when vehicle approaches station 22, car 20 detaches from vehicle 11 and decelerates so as to stop at station 22 and to unload passengers at station 22 when vehicle 11 continues moving at a desired speed and integrates with car 18 as described above.

In some embodiments, car 20, which is the unloading car, is positioned at the rear of vehicle 11. Moreover, after integrating with vehicle 11, car 18 constitutes the front car of vehicle 11 as described above.

In the example of FIG. 1, only one car (e.g., car 18) loads passengers from station 22, and only one car (e.g., car 20) unloads passengers at station 22. In other embodiments, at least one of the loading and unloading cars may comprise any suitable number of cars. For example, in case station 22 is a central station of a metropolis, when a large volume of passengers arrives in station 22 (e.g., in morning trains), the unloading car (e.g., car 20) may comprise multiple cars. Similarly, when a large volume of passengers depart from station 22 (e.g., in afternoon and evening trains), the loading car (e.g., car 18) may comprise multiple cars.

In some embodiments, car 26 is loading passengers at station 24, and starts moving along route 33 in direction 44 when vehicle 11 is positioned (while moving) at a predefined distance from station 24. Note that after integrating with vehicle 11, car 26 is the front car of vehicle 11 and car 18 will become the second car of vehicle 11.

In such embodiments, the position of one or more cars of vehicle 11 within vehicle 11, is changing along route 33. For example, between stations 30 and 22 car 12 is at the front position and car 20 is at the rear position, and when approaching station 22, car 20 detaches from vehicle 11 and car 16 turns into the rear car of vehicle 11. Similarly, between stations 22 and 24, car 18 is at the front position and car 16 is at the rear position, and when approaching station 24, car 16 may detach from vehicle 11 and car 14 may turn into the rear car of vehicle 11.

Note that in some cases vehicle 11 may pass by a given station without detaching one or more cars, and/or without integrating with a car loading passengers from the given station. In an embodiment, car 16 may not detach from vehicle 11 between stations 22 and 24, and may remain the rear car having a different destination, e.g., station 29. In this embodiment, vehicle 11 may integrate with car 26 between stations 24 and 29 and may have five cars (e.g., cars 26, 18, 12, 14 and 16) before detaching from car 16 when approaching station 29.

In some embodiments, a passenger typically boards an origin car that, after the integration, is located at the front of vehicle 11. During the ride the passenger moves within vehicle 11 in a direction 77 (opposite to direction 44), toward a destination car that is located at the rear of vehicle 11. For example, a passenger traveling from an origin station (e.g., station 28) to a destination station (e.g., station 22), may board car 12 at station 28 and walk (or be moved using any suitable technique) along vehicle 11 to car 20, so as to de-board at station 22. In case the destination station of the passenger is station 29, he or she may walk from car 12 to car 14, which is designated to stop at station 29 and de-board from car 14. Note that moving passengers, within vehicle 11 in direction 77, prevents crowding and passengers congestion, and therefore, improves the mobility and flow of the passengers within vehicle 11.

In accordance with the embodiments described above, for a typical passenger each car is a direct car to its destination station. In the context of the present invention and in the claims, the term "direct car" refers to the fact that once boarding an origin car at the origin station, a given passenger moves along vehicle 11 to its destination car and typically stops only at its destination station. In other words, the given passenger does not waste time due to a stop at any station located between the origin and destination stations, because vehicle 11 constantly moves. Therefore, from the passenger perspective, after boarding, the destination car stop only at the destination station. Moreover, a passenger sits at his or her destination car until the car is detached from vehicle 11 and stops at the destination station, while typically vehicle 11 has not changed its original (e.g., cruising) speed since departure from the origin station.

Typically, when accessing a station of system 10, a passenger does not have to wait for a specific car and can take the next car. In some embodiments, system 10 is configured to route the cars and vehicles to transport the passenger to its destination station using various techniques described below. Moreover, due to the direct car and non-stop vehicles, the transportation is faster and the passenger spends less time commuting.

In some embodiments, in case the destination car is not yet coupled to vehicle 11, the passengers may await at one of the cars of vehicle 11, for a notice that their destination car is integrated with vehicle 11 and is available for them. In such embodiments, a passenger may (a) remain in the origin car that has a destination station that matches the passenger's destination station, or (b) move to the destination car that has not yet been integrated with vehicle 11. Note that in scenario (a), the passenger will not move in direction 77, and simply de-board the same car at the destination station.

Signage within Elements of the Transportation System

In some embodiments, system 10 comprises at least the following elements: vehicles having one or more cars, cars not connected to vehicles, and the aforementioned stations located along route 33. In some embodiments, system 10 has signs for assisting the passengers in reaching their destination in the most effective manner. In some embodiments, digital (electronic) signs are positioned (a) in every station, (b) in every car, and (c) the passengers may have a handheld device, such as a smartphone or a head-mounted display (HMD), which is connected to the control sub-system of system 10 and displays information regarding the schedule and destination of each car of system 10.

In some embodiments, each station has signs indicative of the departure and arrival times of cars at the station, and optionally on departures and arrivals of cars at other stations of system 10. In the example of FIG. 1, the signs of station 22 may display the arrival time of car 20 and the departure of car 20 that will be integrated with the next vehicle (not shown) following vehicle 11. Similarly, the signs of station 24 may display (a) the departure time of car 26, and in case car 16 is scheduled to detach from vehicle 11 and to stop at station 24, the signs will display (b) the arrival time of car 16. Note that the signs of each station may also display information regarding other stations along route 33 and the destination of each car currently integrated in vehicle 11.

In some embodiments, each car has a sign that marks the destination station thereof. The sign may also comprise a mapping of all the cars of system 10, which are lit according to coupling and destination station. Such signs provide the passengers with information on the destinations of all cars currently integrated in vehicle 11. Thus, each passenger knows his or her destination car in order to reach the respective destination station.

In some embodiments, the signage of each car displays the car status (e.g., coupling status, origin and destination), the position of each car within vehicle 11, and whether or not passengers can move from the respective car toward their destination car of vehicle 11. For example, when car 18 departs from station 22, but is not yet safely coupled to vehicle as shown in FIG. 1, the signage displays that passengers of car 18 cannot move toward the rear of vehicle 11. Similarly, before car 20 detaches from vehicle 11, the signage of cars 12, 14 and 16 display the remaining time for safely passing to car 20. At a predefined time interval (e.g., ten seconds) before detaching car 20, the signage of cars 12, 14 and 16 may indicate that car 20 is no longer available for the present passengers of vehicle 11. Moreover, the signage of car 20 may have a count-down display for the arrival of car 20 in station 22.

In some embodiments, the signage may display the status and destination of each car of system 10, or of some of the cars of system 10. In the context of the present invention, the term "status" may refer to at least one of (a) whether the car moves or stops, (b) whether the car (i) loads passengers, or (ii) unloads passengers, or (iii) in idle or mode (e.g., for technical maintenance, or cleaning). For example, a moving car may be highlighted, and displays its corresponding destination.

In such embodiments, a car that is positioned at a given station, and therefore is not moving, may have a corresponding indication of its status as described above, and a sign indicative of its destination that may be displayed at all stations, cars and personal displays. Moreover, the signage may provide users with an indication of whether or not each car is dynamically coupled to a respective vehicle. In the example of FIG. 1, the signage will indicate that cars 12, 14 and 16 are dynamically coupled to one another, whereas cars 18 and 20 are moving but are not coupled to any car of vehicle 11.

In some embodiments, the signage may be carried out using color-coding, letters, lit and unlit, characters, or any other suitable marking indicative of the status of the respective car. Additionally, each car may have the destination thereof shown on the outer surface of the car so that passengers at the respective stations will be able to see the destination of the respective car.

In some embodiments, passengers having a personal displaying device, such as but not limited to the aforementioned smartphone or HMD, may have all the information described above displayed on the personal device. In such embodiments, the personal device may provide the user with the destination of the car he or she is currently located in, and may further provide the user with the position of its destination car and the estimated arrival time of the destination car at the destination station.

This particular configurations of the signage of system 10 are described by way of example, in order to enhance the performance and ease-of-use of system 10. Embodiments of the present invention, however, are by no means limited to this specific sort of example signage configurations, and the principles described herein may similarly be applied to other sorts of signage in system 10 or in any other types of transportation systems.

Control Sub-System of the Transportation System

In some embodiments, system 10 comprises the aforementioned control sub-system. In an embodiment, the control sub-system may be centralized, referred to herein as a central control unit (CCU). In another embodiment, the control sub-system may be distributed, referred to herein as a distributed control unit (DCU). For example, a DCU may be positioned at the large stations of system 10 that are distributed along route 33 and/or in at least some of the aforementioned cars of system 10.

The embodiments below are described for the CCU, but are also applicable to the DCU.

In some embodiments, the CCU may comprise various types of sensors, communication devices, controllers and processors (described in detail below), which are configured to accurately assess the position, speed and acceleration of each car in real-time.

In some embodiments, based on the sensed and communication signals, a processor of the CCU is configured to estimate and/or specify various parameters related to components (e.g., each car and vehicle) of system 10. The parameters may comprise (a) speed, (b) acceleration and deceleration, (c) distance between adjacent car or vehicle, (d) distance to/from closest station, (e) status of each car, such as but not limited to detaching from a vehicle, integrating with a vehicle, awaiting at a station, (f) status of the vehicle, e.g., number of cars and motors integrated in the vehicle, and (g) braking capabilities.

In the context of the present disclosure and in the claims, the term "braking capability" refers to at least one of (i)

reducing the power applied to a motor (e.g., electrical, diesel) driving the respective car, and (ii) applying a mechanical braking assembly (e.g., friction-based) for stopping the respective car. Both braking capabilities are affected by various parameters, such as but not limited to (a) total weight of the car, (b) materials of the mechanical braking assembly, (c) number of mechanical braking actuators used (e.g., not bypassed) in the braking assembly, (d) latency period for activating a braking actuator (e.g., building a pressure in braking pistons), and (e) temperature of the braking environment and of elements of the mechanical braking assembly.

In some embodiments, the CCU is configured for signaling and controlling the components speed, acceleration and for commanding coupling and/or de-coupling between at least two cars and between a car and a vehicle.

The CCU is further configured to command cars and/or vehicles to abort coupling and/or decoupling processes when required. As will be described in detail below, one or more of the control sub-systems (e.g., CCU, and/or in stations, and/or in cars) are configured to control the cars and stations for maintaining a safety distance between adjacent components (e.g., cars). In other words, based on the signals received from at least one of the sensors and the communication devices the control sub-system is configured to specify the configuration of at least one of the vehicle (e.g., vehicle 11) and one or more of the aforementioned cars of system 10.

Typically, the control sub-system comprises a general-purpose computer having at least a processor and/or a controller, which is programmed in software to carry out the functions described herein. The software may be downloaded to the computer in electronic form, over a network, for example, or it may, alternatively or additionally, be provided and/or stored on non-transitory tangible media, such as magnetic, optical, or electronic memory.

Additional embodiments related to the control sub-systems and components thereof in the stations and the cars of system 10 are described in detail below.

In the context of the present disclosure and in the claims, the terms "integrate with" and "couple to" are used interchangeably, the terms "detach" and "decouple" are used interchangeably, the terms "loading" and "boarding" are used interchangeably, and the terms "de-boarding" and "unloading" are used interchangeably.

Addressing Specific Scenarios and Requirements of the Transportation System

In some cases vehicle 11 may have less cars than number of stations. In some embodiments, one or more given cars of vehicle 11 may have respective destination stations, but also intermediate destination stations. In such embodiments, the passengers will wait in the given car they boarded until the car of their destination is picked up later, and then pass to their destination car at the front of vehicle 11.

In some embodiments, system 10 is configured to manage connection of passengers between different routes having at least one common station. For example, a passenger departing from Pittsburgh Pennsylvania with a destination station at Richmond Virginia, will wait at a given car dropped-off at the Baltimore station, and the given car will be integrated with the vehicle coming from New York using the same techniques described above for car 18 and vehicle 11. After the integration, the passenger may walk to the destination car intended to stop at Richmond as its destination station.

In order to avoid passengers moving in direction 44 towards the front of vehicle 11, an alternative embodiment of system 10 is possible in cases where destination car is unavailable due to a short vehicle 11. In this embodiment, the passengers remain in an "intermediate car" but may not de-board from the intermediate car even though the intermediate car is detached from vehicle 11 and stops at a station, because the intermediate car will integrate with a subsequent vehicle (other than vehicle 11). After the integration with the subsequent vehicle, the passengers will move towards the back of the subsequent vehicle, to the destination car of their destination.

In some embodiments, the cars constituting vehicle 11 may be concatenated or split to allow better utilization of the shared vehicles. Because the passengers typically sit in their destination car before the splitting, the passengers do not move while vehicle 11 is being split, thus avoiding safety events. In such embodiments, when accessing a station (e.g., by foot), each passenger may relate to the car awaiting at the platform as his or her next car, assuming that all cars and vehicles that are sharing the same line are concatenated and/or split as needed. These embodiments are applicable for all passengers because each vehicle that passes through a station can arrive to all possible stations by concatenating and splitting.

In some embodiments, a vehicle having a first set of cars of system 10, such as vehicle 11, is configured to merge with another vehicle having a second set of cars, and/or to split into multiple sub-vehicles. In such embodiments, when a vehicle splits into two or more sub-vehicles, at a splitting point, the rear-most-sub-vehicle (also referred to herein as the second set of cars), reduces its speed to a predefined speed, so as to have a safety distance and to allow the one or more front sub-vehicles (also referred to herein as the first set of cars) to leave the splitting point.

In some embodiments, after obtaining the safety distance, the one or more front sub-vehicles and the rear-most-sub-vehicle are routed, each, by the CCU of system 10 to their respective routes, and the rear-most-sub-vehicle restores its original or planned speed.

Similarly, when merging two vehicles into a merged vehicle, at the merging point, the speeds are matched and the coupling is carried out in a like manner to the aforementioned dynamic coupling between a single car and a vehicle using the techniques described above.

In some embodiments, safety is obtained using a transition mechanism, which allows both cars (the rear and the front) to know, with sufficiently-high accuracy and confidence level, the actual distance and speed difference during the entire coupling process between adjacent cars and thereafter.

In some embodiments, in case of a communication-loss event during the dynamic coupling, the rear car (or the rear-most-sub-vehicle) stops immediately and the front car (or vehicle) also stops but after a time interval (depending on the position and speed of the cars), and at a lower deceleration rate, so as to maintain a safety distance therebetween. In other words, in case of a communication-loss event during dynamic coupling of front and rear cars, the front car will always move faster than the rear car so as to prevent a collision and to obtain a safety distance therebetween.

In some embodiments, each car of system 10 is configured to use the same communication and synchronization techniques in case of a need for an emergency stop at a given car. In such embodiments, the vehicle may start decelerating and/or stopping, and send a signal to the car in front of it that it can start decelerating and/or stopping at a slightly lower rate than the vehicle (e.g., vehicle 11), in order to maintain the safe distance between the vehicle and the front car.

In other embodiments, the same emergency stop technique may be applied to any car within vehicle 11 or to any other vehicle. For example, in a vehicle comprising three cars, referred to herein as a front car, a middle car, and a rear car, which may have an uncontrolled fire event in the middle car. After evacuating the passengers from the burning middle car, the front car decouples from the burning middle car and moves at the fastest speed from among the three cars. In such embodiments, the burning middle car moves at a speed slower than that of the front car, and the rear car, which is also decoupled from the burning middle car, moves at the slowest speed from among the three cars. In such embodiments, the CCU may control a diversion apparatus in route 33 to divert the burning car to a suitable different route and to stop the burning car for extinguishing the fire and other types of emergency activities at a designated safety area.

Using Short Vehicles for Short-Distance Transportation

In some cases, the distance between two or more adjacent stations may be short due to high density of passengers or goods distributed within a short section of the route. For example, in a metropolis (for passengers and parcels) and in a seaport or airport (for large cargo) there are typically multiple short distances between adjacent station. In such cases, a passenger boarding the front car may have to rush to his or her destination car, and in some cases, the passenger may not be able to reach the destination car on time.

In some embodiments, the control sub-system of system 10 is configured to specify the number of cars in vehicle 11, e.g., based on the distance between at least two adjacent stations of route 33.

In some embodiments, system 10 may comprise a combination of (a) long vehicles for long distances between adjacent stations as described above, and (b) shorter vehicles (e.g., having less cars) for serving sections of a route having short distances between adjacent stations. For example, a shorter vehicle may comprise two or three cars, so that a passenger have to move only one or two cars during the ride between two adjacent stations, and therefore, may not have a problem to get to his or her destination car on time. Note that both the long and short vehicles are not stopping at stations of the metropolis, but are detaching from and coupling to cars before and after the stations, respectively.

In other embodiments, system 10 may comprise a combination of vehicles that are not stopping, referred to herein as non-stop vehicles such as vehicle 11, and "traditional vehicles" that stop at predefined stations for loading and unloading objects (e.g., passengers or parcels). For example, system 10 may comprise three non-stop vehicles, such as vehicle 11, and one traditional vehicle. In such embodiments, the first and second non-stop vehicles (e.g., arriving from stations out of the metropolis) may only detach cars at given stations so that passengers may have enough time for being at their destination cars well before the destination car detaches from the respective vehicle.

Subsequently, the traditional vehicle may load passengers at the given stations and transport them to their destination within the metropolis. Finally, the third non-stop vehicle may couple to cars loading passengers from the given stations and/or other stations, for transporting these passengers to stations located at distances long-enough that provide passengers with enough time to reach their destination car on time. Note that at least one of the three non-stop cars may both load and unload passengers at predefined stations. For example, a first non-stop vehicle may only detach cars, a second non-stop vehicle may detach from and integrate with cars, and a third non-stop vehicle may only integrate with cars.

In yet other embodiments, system 10 may comprise only non-stop vehicles that may move fast between metropolises and slower within the metropolises so as to provide the passengers with enough time to safely reach their destination cars before the detachment. Additionally or alternatively, system 10 may dynamically adjust the speed of the non-stop vehicles based on information received from the ticketing system. Note that the speed adjustment is limited so as to maintain the original schedule of the loading and unloading at the stations of system 10.

In other embodiments, system 10 may comprise two cars, denoted cars "A" and "B," and a single station. In such embodiments, car "A" loads passengers from the station and integrates with car B, and when approaching the station, car "B" detaches from car "A" and unloads passengers at the station. This minimal configuration may be used, for example, for improving the utilization of an attraction in an amusement park, or for any other suitable application for transporting passengers and/or goods.

Dynamic Car Planning for Transporting a Large Number of Objects to and from Stations In case of a large event, such as a football match or a big concert, a large number of passengers is expected to board at a first station, and another large number of passengers is expected to de-board at another station.

In some embodiments, the control sub-system of system 10 is configured to receive information from the ticketing system, and based on the information, to specify and/or adjust the number of cars at the first station, in response to the unusual number of passengers. For example, a first non-stop vehicle may detach, in the first station before the large amount of passengers are boarding, three cars instead of one. Subsequently, a subsequent second non-stop vehicle, may integrate with the three cars having the large amount of passengers returning from the event, and detach the three cars at the second station so as to unload at least some of the passengers returning from the event, at their destination station.

Note that in case the ticketing system receives bookings for more than one destination stations, the second non-stop vehicle may detach two of the cars at the second station and the remaining additional cars at the third station. These embodiments are also applicable for rush hours in crowded areas, such as a metropolis (for passengers and/or parcels) and a port (for cargo).

In alternative embodiments, based on the information received from the ticketing system indicative of unusually large number of objects at the first station, the control sub-system is configured to specify (e.g., limit) the number of tickets for the second non-stop vehicle and the remaining passengers may be permitted to board a subsequent third non-stop vehicle.

In other embodiments, vehicle 11 and the cars of system 10 may comprise any other suitable type of transportation equipment, such as but not limited to a bus, an intercity train, a light train, a suburban rail, an underground train, a boat, an automobile, a truck, and a cargo carrier (e.g., a train, a truck or a ship). In yet other embodiments, vehicle 11 may comprise an aircraft (e.g., a drone) configured to carry passengers and/or parcels along a predefined route, and the cars may comprise smaller drones configured to load and unload the passengers and/or parcels between the aircraft and the stations.

In alternative embodiments, vehicle 11 is configured to stop for coupling to and/or for detaching cars. These embodiments may be useful in case the dynamic coupling and detaching is too complicated and/or risky. This operational mode reduces some of the benefits for passengers, and may result in a long delay to passengers that plan to de-board at intermediate stations and longer overall cycle time of route 33.

In other embodiments, vehicle 11 may slow down before stations so that the dynamic coupling and decoupling (or detaching) may be carried out at lower speed. For example, if the cruising speed of vehicle 11 between stations is about 400 km per hour (KPH), the speed may decline to about 100 KPH before the dynamic coupling and/or decoupling. In other embodiments, this intermediate concept may be applied using any other suitable operational mode subject to the type of transportation as described above. For example, the speed acceleration and deceleration may differ between an intercity train and a suburban rail, and between transportation of passengers and cargo.

This particular configuration of system 10 is shown by way of example, in order to illustrate certain problems that are addressed by embodiments of the present invention and to demonstrate the application of these embodiments in enhancing the performance of such a transportation system. Embodiments of the present invention, however, are by no means limited to this specific sort of example system, and the principles described herein may similarly be applied to other sorts of transportation systems.

Cars and Stations of the Transportation System

FIG. 2 is a schematic rear view of car 14 of system 10, in accordance with an embodiment of the present invention. Note that the following embodiments of car 14 are applicable for all the cars of system 10.

In some embodiments, each car and a multi-car vehicle of system 10 may comprise one or more sensors and/or cameras configured to sense when the car passes through a station or any sign positioned along route 33. For example, before each station, route 33 may have signs for starting and completion of car detaching from the respective vehicle. Similarly, after each station, route 33 may have signs for starting and completion of car integration with the respective vehicle. As described above, the control sub-system may comprise the sensors and receive their signals for controlling system 10.

In some embodiments, route 33 may further have signs for decelerating and accelerating before and after the station, respectively. Route 33 further comprises one or more signs for full-stop position of one or more respective cars within the station.

In some embodiments, each car further comprises at least a controller, which is configured to receive from the sensors and/or cameras electrical signals indicative of the position of the car along route 33, and to control parameters related to operations of the car, such as but not limited to: (a) speed, (b) acceleration and deceleration, (c) distance form adjacent car or vehicle, (d) distance to/from closest station, (e) detaching from and integrating with the respective vehicle, and (f) braking capabilities described in detail in the section of the control sub-system above. Note that the control sub-system typically comprises the controller instead of or in addition to the processors and/or controllers described above.

Typically, the controller comprises a general-purpose controller, which is programmed in software to carry out the functions described herein. The software may be downloaded to the controller in electronic form, over a network, for example, or it may, alternatively or additionally, be provided and/or stored on non-transitory tangible media, such as magnetic, optical, or electronic memory.

In some embodiments, each car may further comprise at least a memory device, a communication device, a global positioning system (GPS) device, and one or more displays for administrating the car operations. The communication device is configured to send at least some of the aforementioned parameters to the control sub-system of system 10, and to receive operational instructions from the control sub-system of system 10 and/or from a controller of at least the next station along route 33.

In some embodiments, the communication devices of at least adjacent cars are configured to exchange communication signals therebetween. For example, before, during and after dynamic detaching and/or dynamic coupling between two adjacent cars.

In some embodiments, based on the information from the cars, vehicles, and various sensors positioned within the stations and along route 33, the CCU is configured to display how many cars are integrated in each vehicle, and the position, speed, origin and destination, and other parameters of each car and vehicle along route 33.

Additionally or alternatively, the CCU may continuously receive from each car GPS signals indicative of the position of each car, and based on the GPS signals, to display at least some of the information described above.

In some embodiments, car 14 comprises wheels 34, which are configured to enable the moving of car 14 along direction 44. In other embodiments, car 14 may have any other suitable apparatus configured for moving car 14. For example, instead of or in addition to wheels 34, car 14 may comprise superconducting parts that enable moving car 14 by magnetic levitation, or using any other suitable technique.

In some embodiments, car 14 comprises at least one automatic door 31 positioned at one or both sides of car 14 for boarding and de-boarding from the station platform. In the example of FIG. 2, car 14 comprises door 31 at each side of a cabin 32 of car 14. In such embodiments, car 14 (and every car of system 10) may be autonomous or remotely controlled for opening and closing at least one of doors 31. For example, after obtaining a full stop at a destination station, or when preparing to depart an origin station and to accelerate for obtaining the aforementioned dynamic coupling.

In some embodiments, car 14 further comprises first and second automatic doors (not shown) located, respectively, at the front and at the back of car 14. In the example shown in FIG. 1, the first door allows passengers to move from car 12 into car 14, and the second door allows passengers to move from car 14 into car 16. As described in FIG. 1 above, when cars 12, 14 and 16 are moving, the passengers are typically moving in direction 77 and therefore typically enter car 14 through the first (i.e., front) door and exit car 14 through the second (i.e., rear) door.

In some embodiments, at least one of the front and rear doors is closed when a car is not connected to another car, and particularly to a vehicle when the car is moving. In such embodiments, the respective door may be opened by a passenger only after the car safely coupling with the respective vehicle.

In some embodiments, car 14 may comprise an inner channel, referred to herein as a rail 66, which is located below cabin 32 as shown in FIG. 2. Rail 66 is configured to enable movement of a locomotive motor, referred to herein as a locomotive 55 between cars of vehicle 11 so as to connect locomotive 55 to a destination car of vehicle 11. Reference is now made to FIG. 1, a first locomotive 55 moves car 18 along route 33. After car 18 is integrated with vehicle 11, first locomotive 55 may be moved through rail 66 of car 18, and be connected with any other car of vehicle 11 (e.g., car 14) for driving vehicle 11. Before detaching from vehicle 11, a second locomotive 55 of vehicle 11 may be moved to car 20 for driving car 20 safely to station 22.

In some embodiments, system 10 may have any number of locomotives 55 distributed between the cars and vehicle 11 using any suitable configuration. For example, all the cars of vehicle 11 may share two locomotives 55, and each car that is not connected to vehicle 11 may have locomotive 55 for moving the car after loading passengers at the respective station.

In other embodiments, at least one, and typically each car of system 10 may comprise a separate motor, such as an electrical motor of a diesel motor. In such embodiments, system 10 may comprise an electric multiple unit (EMU), which is a multiple-unit train consisting of self-propelled cars using electricity as the motive power. The EMU may not require a separate locomotive, such as locomotive 55, as electric traction motors are incorporated within one or more of the cars. The EMU configuration may be used in areas having a grid, such as in suburban rails, and may have an exemplary configuration of one EMU driving two or three cars.

In alternative embodiments, instead of locomotives 55 or EMU, system 10 may be powered by a diesel multiple unit (DMU), which is a multiple-unit train powered by on-board diesel engines. Similarly to the EMU, the DMU requires no separate locomotive, as the engines are incorporated into one or more of the cars. Additionally or alternatively, one or more of the cars of system 10 may be powered using any suitable type of diesel transmission, such as but not limited to diesel-mechanical (DMMU), diesel-hydraulic (DHMU), or diesel-electric (DEMU).

Configuration and Capabilities of Stations Located Along the Route

The embodiments described below are applicable for one or more stations of system 10, referred to herein as "the station" and typically to all the stations of system 10.

In some embodiments, the station may comprise one or more sensors configured to sense when a car and a multi-car vehicle are passing. The station may comprise one or more processing devices, memory, communication devices, one or more cameras, and one or more displays for administrating the station activities.

In some embodiments, at least some of the sensors and cameras may be positioned along route 33, before and after the station so as to send signals indicative of the detaching and integration between cars and a respective vehicle before and after the vehicle passes through the station.

In some embodiments, the processing device, also referred to herein as a processor, is configured to receive from the sensors and cameras signals indicative of cars and vehicles passing along route 33, before, through and after the station. The processor is further configured to calculate various parameters related to each of the cars and vehicles. In some embodiments, the parameters may comprise: (a) speed, (b) acceleration and deceleration, (c) distance to adjacent car or vehicle, (d) distance to closest station, and (e) braking capabilities as described above in the description of the CCU.

Typically, the processing device comprises a general-purpose processor, which is programmed in software to carry out the functions described herein. The software may be downloaded to the processing device in electronic form, over a network, for example, or it may, alternatively or additionally, be provided and/or stored on non-transitory tangible media, such as magnetic, optical, or electronic memory. Note that the control sub-system of system 10 typically comprises and controls all the controllers and processors disposed at the cars and station as described above.

In some embodiments, at least one station of system 10 is configured to guide a car precisely to its full-stop position, using any suitable guiding mechanism. The station may have one or more positions, e.g., platforms, for loading and unloading objects, such as passengers and/or cargo.

In some embodiments, the station may comprise at least a service area for various activities, such as for maintenance, repairing, replacement and charging of batteries, and for filling diesel, oil, water or other fluids. The station may have other additional positions for any suitable functionality. In such embodiments, the status of a car in the service area may be defined as "not operational" or "in service."

As described in the signage chapter of FIG. 1 above, the station comprises a suitable signage system with displays at the platforms, entrance, exit, ticketing area and at any other suitable location thereof.

In some cases, vehicle 11 or any other vehicle, may pass by a station without detaching or collecting a car. In some embodiments, the station is configured to allow passage for non-stop transit of a vehicle that is not collecting cars at this station. In such embodiments, the station may have multiple rails and/or roads and/or platforms as in traditional train and bus stations. Such vehicle may comprise a long-distance vehicle carrying passengers and/or cargo.

Moreover, at least one station of system 10 may be allocated solely for passengers or for cargo. In some embodiments, the station is configured to allow non-stop passage for such vehicles. For example, a station allocated for passengers only, is configured to allow non-stop passage of a cargo vehicle.

In some embodiments, the station is configured to assign the car to the next vehicle at a predefined position (at the station) and schedule.

In some embodiments, at least one of the stations of system 10 may have the capability of charging the EMUs and/or of replacing the EMU battery. Moreover, at least one of the stations of system 10 is configured for refilling the DMUs with diesel or other fluids suitable for driving the DMU motors and/or other motors, such as locomotives 55. In case locomotive 55 comprises an electrical motor, the station is further configured to replace the battery of locomotive 55.

Figure 3:
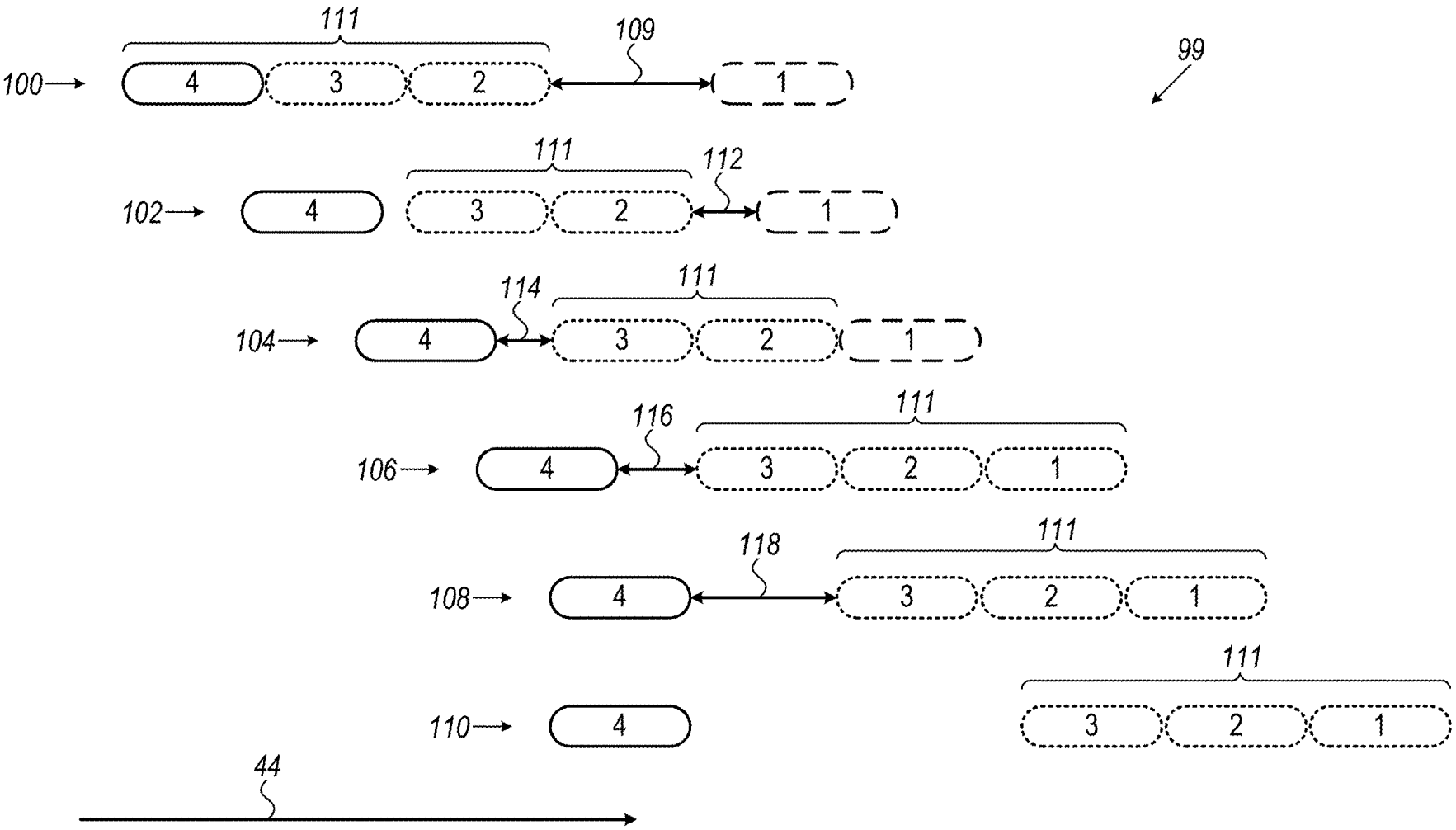
FIG. 3 is a diagram that schematically illustrates a process for loading and unloading passengers using a transportation system, in accordance with an embodiment of the present invention.

FIG. 3 is a diagram that schematically illustrates a process for loading and unloading passengers using a system 99 for transportation, in accordance with an embodiment of the present invention. System 99 may replace, for example, system 10 of FIG. 1 above.

In some embodiments, system 99 comprises cars 1, 2, 3, and 4, some of the cars are temporarily incorporated into a vehicle 111 as will be described herein. At a loading step 100, car 1 loads passengers at an origin station (not shown) and starts moving in direction 44 when the most-front car of vehicle 111 (e.g., car 2) is at a predefined distance 109 from the station. Note that in the configuration of step 100, cars 2, 3 and 4 are incorporated in vehicle 111, such that car 4 is positioned at the rear of vehicle 111.

At a detachment step 102, car 4 detaches from vehicle 111 and slows down relative to the speed of vehicle 111, so as to stop at its destination station (not shown). After exiting the origin station, car 1 accelerates but does not reach the speed of vehicle 111, therefore a distance 112 between cars 1 and 2 is shorter than distance 109 described in step 100 above. In other words, vehicle 111 is getting closer to car 1, as described for vehicle 11 and car 18 in FIG. 1 above. Note that at step 102, vehicle 111 comprises cars 2 and 3, whereas cars 1 and 4 are disconnected from vehicle 111.

At a coupling step 104, vehicle 111 and car 1 are being dynamically coupling with one another. The term "dynamically" is used to describe that vehicle 111 and car 1 are coupling with one another and/or decoupling from one another while both are moving in direction 44, typically at the same speed. Note that due to the deceleration of car 4, a distance 114 is being formed between vehicle 111 and car 4.

At an integration step 106, car 1 is fully integrated as the front car of vehicle 111, and, due to the deceleration of car 4, a distance 116 between vehicle 111 and car 4 is larger than distance 114 shown in step 104 above.

At a stopping step 108, car 4 stops at its destination station while vehicle 111 continues moving at a predefined speed. Typically the predefined speed is not changing along all the steps of FIG. 3, but system 99 may adjust the speed of vehicle 111 (and/or the speed of any car of system 99) at any time for any suitable purpose. Note that due to the stopping of car 4, a distance 118 between vehicle 111 and car 4 is larger than distance 116 shown in step 106 above.

At an unloading step 110, car 4 unloads passengers at the destination station (not shown) while vehicle 111 continues to move at the predefined speed in direction 44.

Figure 4:
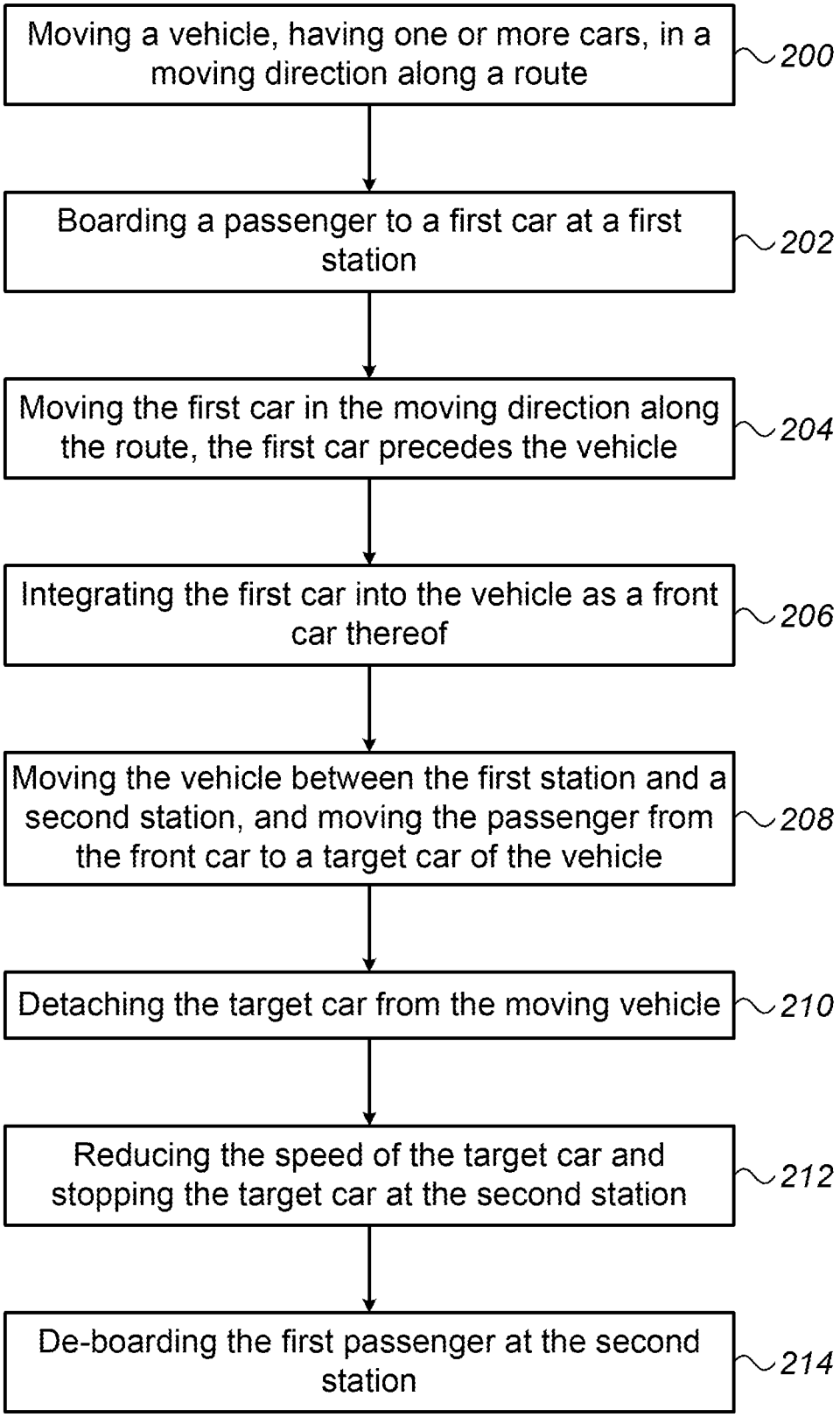
FIG. 4 is a flow chart that schematically illustrates a method for transporting passengers using the transportation system of FIG. 1, in accordance with an embodiment of the present invention.

FIG. 4 is a flow chart that schematically illustrates a method for transporting passengers using system 10, in accordance with an embodiment of the present invention. The method begins at a vehicle moving step 200 with moving vehicle 11 that has one or more cars, in direction 44 along route 33. At a boarding step 202, system 10 receives one or more passengers that are boarding to a first car (e.g., car 18) at a first station (e.g., station 22).

At a first car moving step 204, the first car (e.g., car 18) is moved in direction 44 along route 33. As shown in FIG. 1 above, car 18 departs from station 22 well before vehicle 11 arrives station 22, and therefore, car 18 precedes vehicle 11 in direction 44 along route 33. As also shown in FIG. 3 above, car 1 that corresponds to the first car of the present method, loads passengers and departs from the station when vehicle 111 is behind car 1 at distance 109. In other words, car 1 moves in direction 44 along the route and precedes vehicle 111.

At a first car integration step 206, vehicle 11 moves in direction 44 faster than car 18 so as to reach car 18, and for integrating with vehicle 11 as a front car thereof. The process is described in more detail in steps 102, 104 and 106 of FIG. 3 above: (a) at step 102, vehicle 111 is approaching car 1 and reduces the distance therebetween (e.g., from distance 109 to distance 112), (b) at step 104, vehicle 111 is dynamically coupling with car 1, and (c) at step 106, car 1 is integrated with vehicle 111 as the front car thereof.

At an interstation moving step 208, vehicle 11 is moved between the first station (e.g., station 22) and a second station (e.g., station 24). In some embodiments, the passenger(s) boarded on car 18 at station 22 are moving in direction 77 (opposite to direction 44) from the front car (e.g., car 18) to a destination car (e.g., car 16) of vehicle 11. As described in FIG. 1 above, the destination car is marked (e.g., by signage) as one or more cars intended to stop at the destination station of the respective passengers. In the example of FIG. 1, car 16 is intended to stop at station 24, which is the destination of one or more of the passengers boarded in station 22.

In some embodiments, when vehicle 11 moves between stations 22 and 24 of FIG. 1, the respective one or more passengers may walk in direction 77 from car 18 (located at the front of vehicle 11) to car 16 (located at the rear of vehicle 11). Similarly, one or more passengers having station 29 as their destination, may walk in direction 77 from car 18 to car 14.

In other embodiments, system 10 may have any suitable mechanism for automatically transferring the respective passengers from their origin car (e.g., car 18) to their destination car (e.g., car 16).

At a detaching step 210, the destination car is detaching from the vehicle when approaching the station of destination. In the example of FIG. 1, car 20 is detaching from vehicle 11 when approaching station 22. In the example of FIG. 2, car 4 is detaching from vehicle 111 when approaching the station of destination, as shown in step 102.

At a deceleration step 212, the destination car (that was detached from the vehicle at step 110 above) reduces its speed by applying any suitable deceleration profile, and stops at the destination station, also referred to herein as a second station. In the example of FIG. 3 above, the reduced speed of the destination car approaching the destination station, is reflected in the increased distance between car 4 and vehicle 111. For example, the increasing distances 114, 116 and 118 of respective steps 104, 106 and 108.

At a de-boarding step 214 that terminates the method, the one or more passengers of the destination car are de-boarding at their destination station. For example, as shown in step 108 of FIG. 3 above, the passengers of car 4 are de-boarding while vehicle 111 continues moving along the route.

Although the embodiments described herein mainly address any type of transportation systems, such as trains, the methods and systems described herein can also be used in other applications.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. A system, comprising:

a vehicle, which is configured to move, along a track comprising at least a station, without stopping at the station;

a car, which is configured to:

load an object from the station, which is positioned along the track traversed by the vehicle, and move for integrating with the vehicle; or detach from the vehicle and stop at the station for unloading the object; and a control sub-system having at least: (i) one or more sensors, (ii) a first communication device in the vehicle, (iii) a second communication device in the car, and (iv) a processor, wherein the processor is located within the car and is configured to:

receive signals from at least one of (i) the one or more sensors, and (ii) the first and second communication devices;

control at least a parameter of at least one of the vehicle, the car and the station; and control coupling and de-coupling between the vehicle and the car based on the received signals.

2. The system according to claim 1, wherein the car and the vehicle are configured to integrate with one another, and to detach from one another, while both the vehicle and the car are moving.

3. The system according to claim 1, wherein the car is an origin car and the station is an origin station of the object, and wherein the system further comprises a destination car, which is integrated with the vehicle and is configured to detach from the vehicle and to unload the object at a destination station, wherein, when the origin car and the vehicle are moving between the origin station and the destination station, the object moves from the origin car to the destination car.

4. The system according to claim 1, and comprising a traditional vehicle, which is configured to stop at predefined stations, and wherein the control sub-system is configured to operate the vehicle and the car in conjunction with the traditional vehicle.

5. The system according to claim 1, wherein the parameter comprises one or more parameters selected from a list consisting of: (a) speed, (b) acceleration and deceleration, (c) distance between the car and the vehicle, (d) distance to or from a closest station, (e) status of the car, (f) status of the vehicle, and (g) braking capabilities.

6. The system according to claim 1, wherein the control sub-system is configured to specify, based on the signals received from at least one of the sensors and the communication devices, a configuration of at least one of the vehicle and the car.

7. The system according to claim 6, wherein the track comprises multiple stations and the vehicle having multiple cars integrated therewith, and wherein the control sub-system is configured to specify a number of cars in the vehicle based on a distance between at least two adjacent stations of the track.

8. The system according to claim 6, wherein the control sub-system is configured to specify at least one of: (i) a first number of multiple cars for loading a first plurality of the first object and integrating with the vehicle, and (ii) a second number of multiple cars for detaching from the vehicle and stopping at the station for unloading a second plurality of the second object.

9. The system according to claim 1, wherein the vehicle comprises a first set of one or more first cars positioned at a front of the car and a second set of one or more second cars positioned at a rear of the car, wherein the control sub-system is configured to control a split of the vehicle into a first sub-vehicle comprising the first set and a second sub-vehicle comprising the second set, wherein the first and second communication devices are configured to exchange communication signals with one another, and wherein, in case of a communication-loss during the split, the first set is configured to move at a first speed and the second set is configured to move at a second speed, lower than the first speed.

10. The system according to claim 9, wherein the control sub-system is configured to control the first and second speed for obtaining at least a safety distance between the first set and the second set.

11. A method, comprising:

moving a vehicle along a track comprising at least a station, without stopping at the station;

loading an object from the station, which is positioned along the track traversed by the vehicle, to a car and moving the car for integrating with the vehicle, or detaching the car from the vehicle and stopping the car at the station for unloading the object; and in a control sub-system having at least: (i) one or more sensors, (ii) a first communication device in the vehicle, (iii) a second communication device in the car, and (iv) a processor, wherein the processor is located within the car for:

receiving signals from at least one of (i) the one or more sensors, and (ii) the first and second communication devices;

controlling at least a parameter of at least one of the vehicle, the car and the station; and controlling coupling and de-coupling between the vehicle and the car based on the received signals.

12. The method according to claim 11, wherein loading the object comprises integrating the car and the vehicle with one another while both the vehicle and the car are moving, and wherein detaching the car comprises detaching the car and the vehicle from one another while both the vehicle and the car are moving.

13. The method according to claim 11, wherein loading the object from the station to the car comprises loading the object from an origin station to an origin car, wherein detaching the car from the vehicle comprises detaching a destination car from the vehicle and unloading the object at a destination station, and comprising, when the origin car and the vehicle are moving between the origin station and the destination station, moving the object from the origin car to the destination car.

14. The method according to claim 11, and comprising operating the vehicle and the car in conjunction with a traditional vehicle that stops at predefined stations.

15. The method according to claim 11, wherein controlling at least the parameter comprises controlling one or more parameters selected from a list of parameters consisting of: (a) speed, (b) acceleration and deceleration, (c) distance between the car and the vehicle, (d) distance to or from a closest station, (e) status of the car, (f) status of the vehicle, and (g) braking capabilities.

16. The method according to claim 11, wherein controlling at least the parameter comprises specifying, based on signals received from at least one of the sensors and the communication devices, a configuration of at least one of the vehicle and the car.

17. The method according to claim 16, wherein the track comprises multiple stations and the vehicle having multiple cars integrated therewith, and wherein controlling at least the parameter comprises specifying a number of cars in the vehicle based on a distance between at least two adjacent stations of the track.

18. The method according to claim 16, wherein controlling at least the parameter comprises specifying at least one of: (i) a first number of multiple cars for loading a first plurality of the first object and integrating with the vehicle, and (ii) a second number of multiple cars for detaching from the vehicle and stopping at the station for unloading a second plurality of the second object.

19. The method according to claim 11, wherein the vehicle comprises a first set of one or more first cars positioned at a front of the car and a second set of one or more second cars positioned at a rear of the car, wherein controlling at least the parameter comprises controlling a split of the vehicle into a first sub-vehicle comprising the first set and a second sub-vehicle comprising the second set, and comprising exchanging communication signals between the first and second communication devices, and wherein, in case of a communication-loss during the split, moving the first set at a first speed and moving the second set at a second speed, lower than the first speed.

20. The method according to claim 19, wherein controlling at least the parameter comprises controlling the first and second speeds for obtaining at least a safety distance between the first set and the second set.

* * * * *